US005544951A

United States Patent [19]

Alack

[11] Patent Number: 5,544,951

[45] Date of Patent: Aug. 13, 1996

[54] MIXING MODULE FOR MIXING A FLUENT PARTICULATE MATERIAL WITH A WORKING FLUID

[75] Inventor: Charles S. Alack, St. Louis, Mo.

[73] Assignee: Semi-Bulk Systems, Inc., St. Louis, Mo.

[21] Appl. No.: 316,649

[22] Filed: Sep. 30, 1994

[51] Int. Cl.[6] ..... B01F 15/02

[52] U.S. Cl. ..... 366/163.2; 366/191

[58] Field of Search ..... 366/131, 132, 366/134, 152.6, 153.1, 160.3, 163.1, 163.2, 190, 191

[56] References Cited

U.S. PATENT DOCUMENTS

| | | | |
|---|---|---|---|
| 1,849,945 | 3/1932 | Mobley et al. | 366/190 X |
| 2,017,867 | 10/1935 | Nantz | 366/136 X |
| 2,795,403 | 6/1957 | Mead | 366/163.2 X |
| 3,491,949 | 1/1970 | Hairston | 137/563 X |
| 3,547,409 | 12/1970 | Jacuzzi | 366/163.2 X |
| 3,777,775 | 12/1973 | Handleman . | |
| 3,819,157 | 6/1974 | Markfelt | 366/163.2 X |
| 4,007,921 | 2/1977 | Zingg | 366/136 X |
| 4,054,161 | 10/1977 | Alack . | |
| 4,100,614 | 7/1978 | Mandt | 366/163.2 X |
| 4,149,755 | 3/1979 | Handleman et al. . | |
| 4,186,772 | 2/1980 | Handleman . | |
| 4,863,277 | 9/1989 | Neal et al. | 366/163.2 X |
| 5,211,475 | 5/1993 | McDermott | 366/163.2 X |

OTHER PUBLICATIONS

Tri–Blender Bulletin TB–93; Aug. 1993.
Tri–Clamp Catalog; 1992.
Air–Pallet Ejector Mixer System Brochure Undated, admitted prior art.

*Primary Examiner*—Charles E. Cooley
*Attorney, Agent, or Firm*—Senniger, Powers, Leavitt & Roedel

[57] ABSTRACT

A portable mixing module for preparing solutions and slurries from particulate solid material. The module comprises a portable frame, and an eductor-mixer mounted on and movable with the frame. The eductor-mixer has a first inlet for connection to a source of fluent particulate material, a second inlet for connection to a source of pressurized working fluid, and a discharge for discharging a mixture of the fluent particulate material and the working fluid at a first rate. A surge tank is mounted on and movable with the frame for receiving the mixture discharge from the eductor-mixer. A pump is mounted on and movable with the frame. It has an intake connected to the outlet of the surge tank and a discharge for connection to an outfeed line for delivery of mixture from the surge tank to a remote location. The pump is operable to pump mixture from the surge tank at a second flow rate not substantially less than the first flow rate.

19 Claims, 3 Drawing Sheets

MIXING MODULE FOR MIXING A FLUENT PARTICULATE MATERIAL WITH A WORKING FLUID

BACKGROUND OF THE INVENTION

This invention relates generally to an eductor-mixer system particularly adapted for the preparation of dispersions, solutions and slurries and, more particularly, to a portable system which can be readily moved into a position close to a source of fluent particulate material (e.g., powder or other pressure transportable fluidizable material) for mixing the particulate material with a pressurized working fluid to form a dispersion, slurry or solution which can then be pumped to a remote location.

This invention is generally in the field of co-assigned U.S. Pat. Nos. 4,182,386 and 4,186,772, the former of which relates to a closed system and container for fluidized unloading of powdered material, and the latter of which relates to an eductor-mixer which is operable for receiving fluidized powdered material from the closed container system, for mixing the powdered material with a pressurized working fluid (e.g., water), and for discharging the mixture directly into a suitable receptacle, typically a large tank for processing, storage or the like. While this type of system has enjoyed considerable success, it has not been used extensively in certain industries, including the food industry where it is important that the food processing area remain as dust-free as possible. Although container unloading techniques have improved over the years to reduce the amount of dust created during unloading, the only way to eliminate dust completely is to carry out the unloading process in a location remote from (e.g., partitioned off from) the processing area. However, in an eductor-mixer system of the type described above, involving the fluidized conveyance of material from a container, the container and the eductor-mixer must be positioned relatively close to one another (e.g., within 20 feet). Thus, if the container unloading process is carried out at a remote location, the eductor-mixer may by necessity also be at a location distant from the processing area, or at least distant from sections of the processing area which must be supplied by the eductor-mixer. Under these circumstances, the use of an eductor-mixer type system has not been considered practical, since there has been no provision for conveying product from the eductor-mixer to a distant location at a suitably rapid rate, such as a rate substantially equal to the rate at which product is discharged from the mixer itself.

SUMMARY OF THE INVENTION

Among the several objects of this invention may be noted the provision of a portable mixing module which functions as an in-line mixer capable of mixing a particulate material with a suitable fluid and then pumping the mixture to virtually any desired location, even distant locations; the provision of such a module which provides for flexibility in the placement of the eductor-mixer relative to processing and/or storage tanks which are to receive product discharged by the mixer; the provision of such a module which can be used to mix essentially any fluidizable material with virtually any pressurized working fluid; the provision of such a module which can deliver mixed product in large quantities and at high flow rates to one or more destinations; the provision of such a module which is small and relatively lightweight; and the provision of a module and process for mixing a particulate solid material with a pressurized working fluid to provide a mixture which then can be pumped to a location remote from the eductor-mixer at a rate substantially equal to the rate at which the product is mixed.

Briefly, a portable mixing module of the present invention for preparing dispersions, solutions and slurries from particulate solid material comprises a portable frame, and an eductor-mixer mounted on and movable with the frame. The eductor-mixer has a first inlet adapted to be connected to a source of fluent particulate material, a second inlet adapted to be connected to a source of pressurized working fluid, and a discharge adapted for discharging a mixture of the fluent particulate material and the working fluid at a first rate. The module also includes a small surge tank mounted on and movable with the frame for receiving the mixture discharged from the eductor-mixer. The surge tank has an outlet. A pump is also mounted on and movable with the frame. The pump has an intake connected to the outlet of the surge tank and a discharge adapted for connection to an outfeed line for delivery of mixture from the surge tank to a remote location. The pump is operable to pump mixture from the surge tank at a second flow rate not substantially less than the first flow rate.

This invention also involves an in-line process for mixing a particulate solid material with a pressurized working fluid. The process comprises conveying the particulate material through a first supply line from a source of said particulate material to a first inlet of an eductor-mixer, and pumping pressurized working fluid through a second supply line to a second inlet of the eductor-mixer. The eductor-mixer is operable to mix the particulate material and the working fluid to form a mixture of the particulate material and the working fluid. The method further includes the steps of discharging the mixture from the eductor-mixer into a small surge tank at a first flow rate, and pumping the mixture out of the tank at a second flow rate approximately equal to said first flow rate for delivery to a remote location via an outfeed line.

Other objects and features will in part apparent and in part pointed out hereinafter.

BRIEF DESCRIPTION OF THE DRAWINGS

Corresponding reference numerals designate corresponding parts throughout the several views of the drawings.

DESCRIPTION OF A PREFERRED EMBODIMENT

Figure 1:
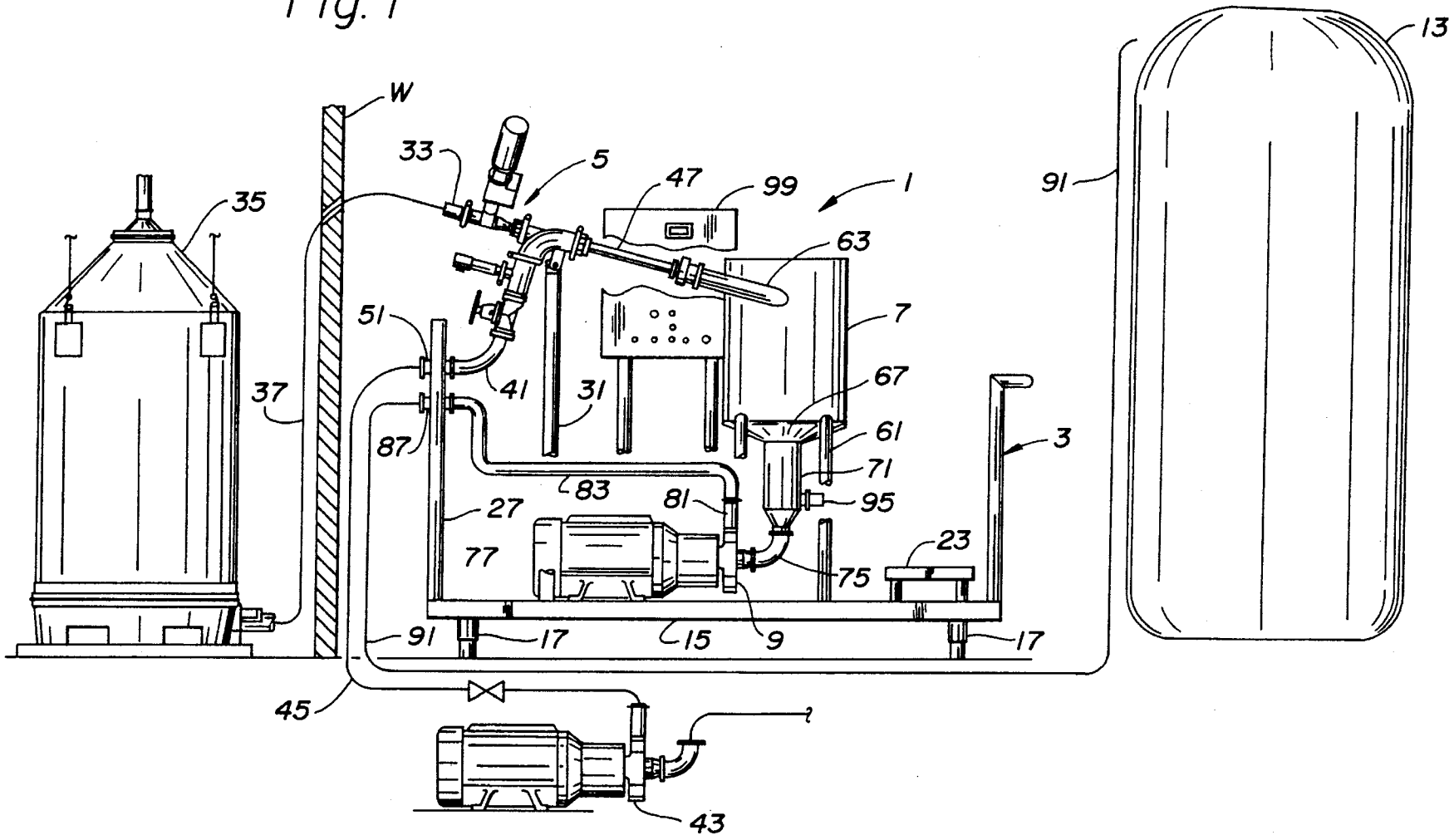
FIG. 1 is an elevational view of a portable mixing module of this invention for mixing particulate material from a container with a liquid and for pumping the resultant mixture to a processing tank.

Referring now to the drawings, and first to FIG. 1, a portable mixing module of the present invention for preparing solutions, dispersions and slurries is designated in its entirety by the reference numeral 1. As shown, the module comprises a portable frame generally designated 3, an eductor-mixer generally designated 5 mounted on the frame, a surge tank 7 mounted on and movable with the frame for receiving mixture discharged by the eductor-mixer, and a pump indicated at 9 mounted on and movable with the frame 3 for pumping mixed product from the surge tank 7 to a remote location, such as the processing tank indicated at 13.

Figure 2:
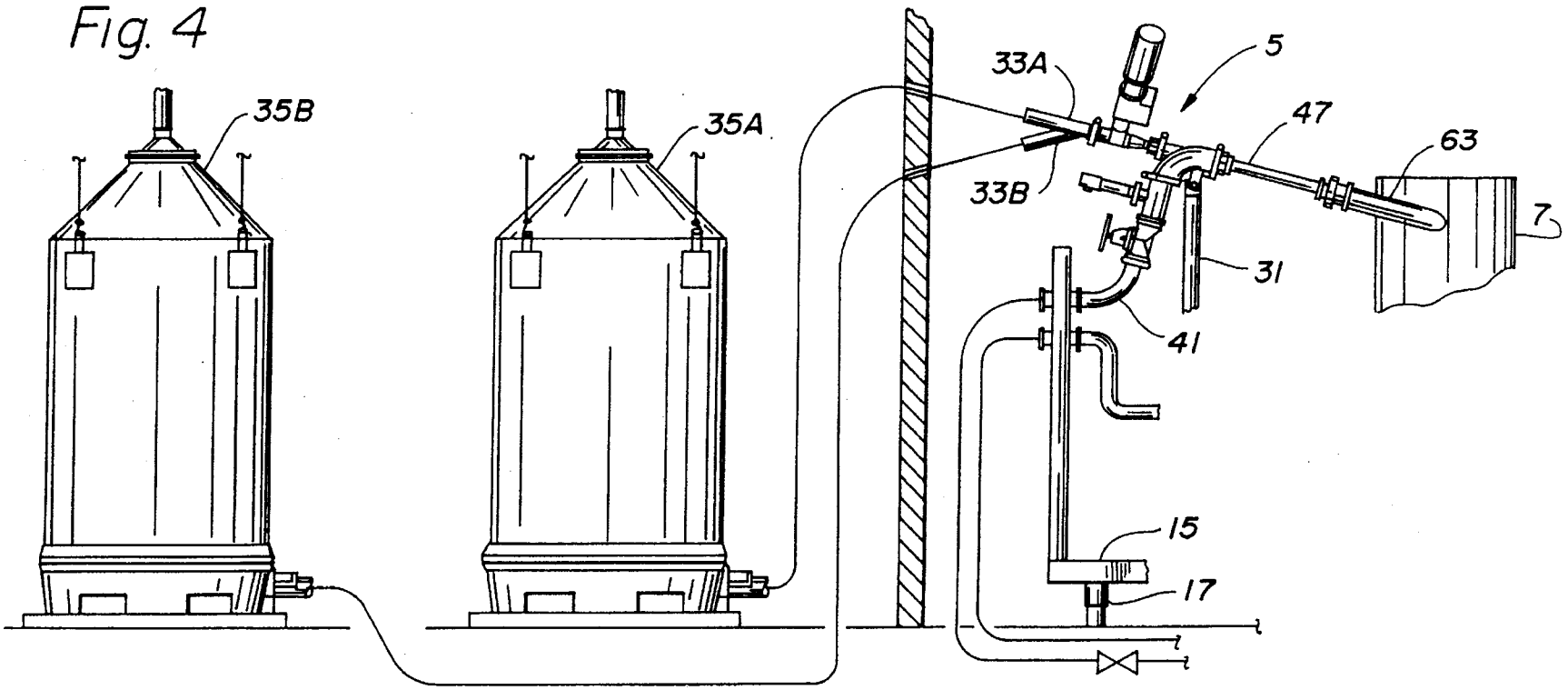
FIG. 2 is an enlarged portion of part of FIG. 1 showing an alternative embodiment of the frame of the module.

The frame 3 comprises a generally rectangular metal base 15 on legs 17. The legs 17 support the base 15 above the floor so the module can readily be moved by forklift truck. In the embodiment shown in FIG. 2, the base is provided with rollers 21 so the module can be readily moved by hand. A platform 23 may be provided adjacent one end of the base to facilitate access to the inside of the surge tank 7. A vertical frame structure 27 extends up from the base at its opposite end (its left end as viewed in FIG. 1).

The eductor-mixer 5 is of the type disclosed in co-assigned U.S. Pat. No. 4,186,772, which is incorporated herein by reference. The eductor-mixer is supported on the frame 3 by means of a post 31 extending up from the base 15 of the frame. The mixer has a first inlet 33 connected to a source 35 of fluent particulate material (e.g., powdered milk, sugar, dry chemicals) via a first connection assembly including a first supply line designated 37. The source 35 may be a flexible bag/pallet container of the type disclosed in co-assigned U.S. Pat. No. 4,182,386, or a hopper system of the type described in co-assigned U.S. Pat. No. 4,848,975, for example, both of which patents are also incorporated herein by reference. In either case, the particulate material is fluidized and then conveyed in a fluidized state to the first inlet 33 of the eductor-mixer through the supply line 37. The eductor-mixer 5 further has a second inlet 41 adapted to be connected to a source 43 of pressurized working fluid via a second connection assembly including a second supply line indicated at 45. This source may be a pump, for example, which pumps a suitable working fluid (e.g., liquid) to the educator-mixer. As explained in U.S. Pat. No. 4,186,772, the eductor-mixer operates to mix the particulate material and working fluid supplied via respective lines 37 and 45 and to discharge the resulting mixture into the surge tank 7 via a discharge conduit 47.

Figure 3:
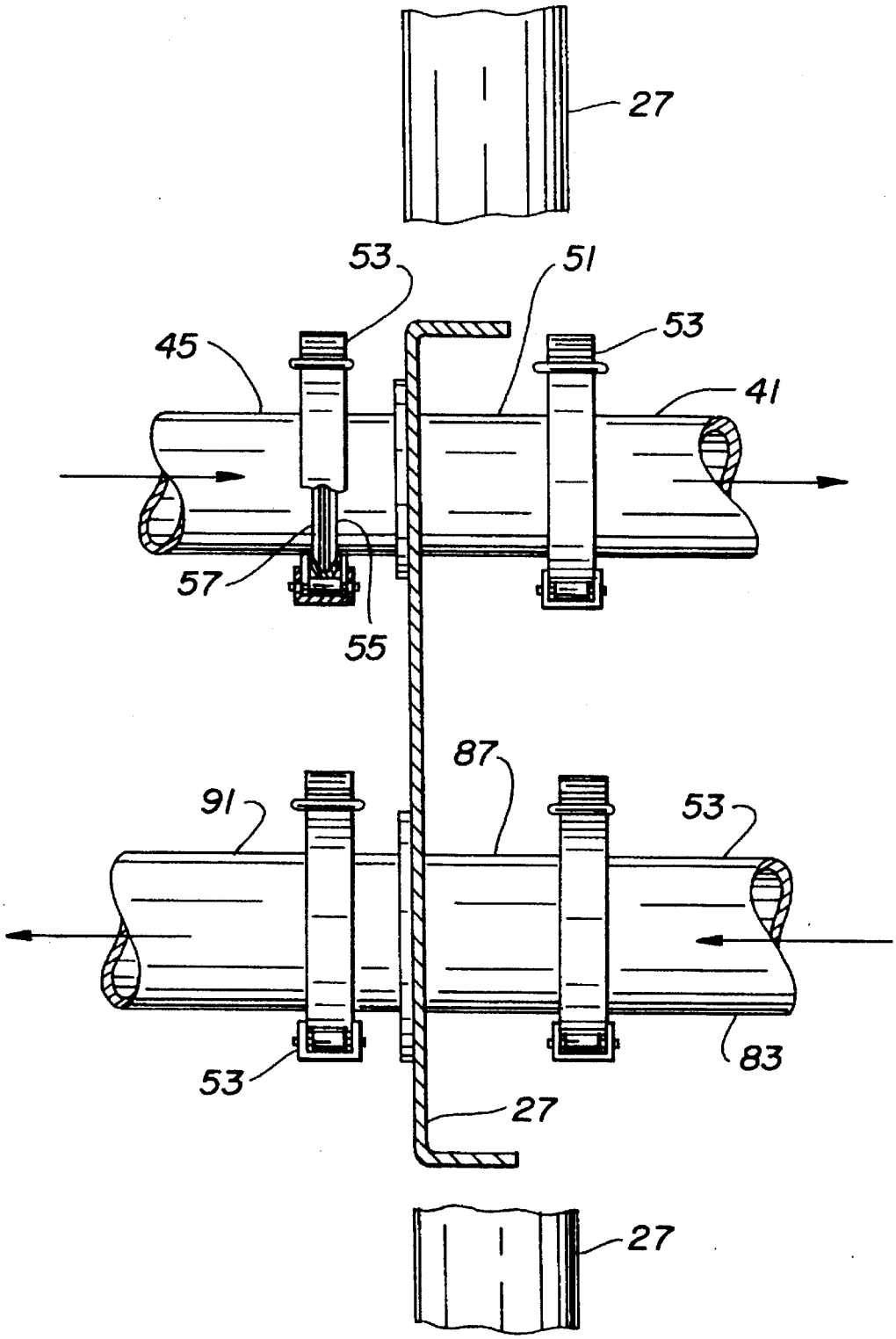
FIG. 3 is an enlarged sectional view of a portion of FIG. 1 showing certain connections.

As shown best in FIG. 3, the working fluid supply line 45 is sealingly connected to one end of a flanged tubular fitting 51 mounted (e.g., welded) in horizontal position on the vertical frame structure 27. The connection is preferably made by a suitable quick-connect, quick-disconnect device such as a quick-action (e.g., toggle-action) hoop clamp 53 of the type commercially available under the trademark TRI-CLAMP® from Tri-Clover, Inc. of Kenosha, Wis. Upon tightening this clamp 53, a flange 55 on the end of the tubular fitting 51 is drawn into sealing engagement with a flange 57 on the end of the supply line 45 to provide a sealing connection. The opposite end of the tubular fitting is sealingly connected by a similar clamping device 53 to the second inlet 41 of the eductor-mixer 5. Other devices may be used to make these connections.

The surge tank 7 is a relatively small, open-top tank of appropriate material (e.g., stainless steel) mounted on the frame 3 by means of legs 61 extending up from the base 15. The tank has an inlet tube 63 coupled by suitable means to the outlet end of the discharge tube 47 of the eductor-mixer 5, and a generally conical bottom 67 with a cylindric outlet 71 extending down from its lower end. The tank 7 is open to atmospheric pressure to avoid any build-up of pressure which might interfere with the proper operation of the eductor-mixer 5 (which must generate a vacuum to draw the fluidized material through line 37).

In accordance with this invention, mixture from the eductor-mixer 5 enters the surge tank 7 at a first rate (e.g., 500–5000 lbs per minute), and mixture exits the tank at a second rate not substantially less than, and preferably substantially equal to, the first rate. As a result, the tank 7 can be small in size, preferably having a maximum capacity of less than the stated first flow rate (in gallons of mixture per minute) multiplied times about two minutes, and even more preferably a maximum capacity of less than the stated first flow rate (in gallons of mixture per minute) multiplied times about 0.2 minutes. The small size of the tank increases the portability of the module.

The outlet 71 of the surge tank 7 is connected to the intake of the pump 9 by means of an elbow indicated at 75 in FIG. 1. The pump 9 may be a positive displacement pump or a centrifugal pump, depending on the product to be pumped, under the control of an ac variable drive 77. The pump has a discharge 81 connected to a discharge line 83 which is connected to one end of a second flanged tubular fitting 87 mounted (e.g., welded) in horizontal position on the vertical frame structure 27. The connection is preferably made by a suitable quick-connect, quick-disconnect device such as a quick-action hoop clamp 53 of the type described above. The opposite end of the tubular fitting 87 is connected by a similar clamping device 53 to an outfeed line 91 through which product can be pumped to a desired location, such as a processing area, or to a mix tank, or to a storage or holding tank (e.g., tank 13). The location can be nearby (e.g.; less than 20 feet) or distant (several hundred feet); it makes no difference. The distance is limited only by the size of the pump 9 and line losses.

As mentioned above, the rate at which the mixture enters the surge tank 7 is preferably approximately equal to the rate at which the mixture exits the tank (i.e., the rate at which the pump 9 pumps mixture from the tank). Inevitably, however, these rates will not always match exactly. Accordingly, provision is made for monitoring the level of mixture in the tank 7 and for controlling the speed of the pump 9 accordingly. Specifically, a level sensor 95 (e.g., a pressure sensor) is mounted on the outlet 71 of the surge tank and is operable to generate output signals indicative of the level of mixture in the surge tank. The variable drive 77 of the pump (which may broadly be referred to as pump control means) is responsive to these output signals for increasing the speed and discharge rate of the pump 9 if the level of mixture in the surge tank rises to or above a first predetermined level, and for decreasing the speed and discharge rate of the pump if the level of mixture in the surge tank falls to or below a second predetermined level. This design maintains the level of mixture in the tank 7 within predetermined limits, which allows the size of the tank to be minimized while avoiding over and under filling.

An electronic control panel 99 mounted on the frame has the controls necessary to operate the pump 9 and valving associated with the eductor mixer.

To use the mixing module 1 of this invention, the portable module is simply moved to a set-up location close to a container (e.g., 35) of particulate material to be mixed with a working fluid. The module should be positioned close to (prefereably within 20 feet of) the container because the conveyance of fluidized material from the conveyor is effected by a vacuum created by the eductor-mixer during its operation, as described in U.S. Pat. 4,186,772. FIG. 1 illustrates a typical use of the invention where the container is located on one side of a wall W to isolate any dust resulting from unloading of the container, and the module of this invention is located close by on the other side of the wall in a "clean-room" environment, such as a food processing area. Alternatively, both the module and the container can be located outside the "clean-room" environment.

To operate the module, the supply line 37 from the container is connected to the first inlet 33 of the eductor-mixer; the supply line 45 from pump 43 is connected to the first tubular fitting 51 on the frame 3; and the outfeed line 91 is connected to the second tubular fitting 87 on the frame. After the material in the container 35 is fluidized, pump 43 is turned on to supply working fluid (e.g., a suitable liquid) to the eductor-mixer. As explained in U.S. Pat. No. 4,186,772, the flow of this working fluid through an annular orifice in the eductor-mixer creates the vacuum necessary to draw fluidized particulate material through line 37 and into the mixing chamber of the eductor-mixer to effect mixing of the material with the working fluid. This mixture is then discharged into the surge tank 7. After the level of product in the surge tank rises to a predetermined level, the take-away pump 9 operates to pump mixture from the surge tank at a rate substantially equal to the rate at which product enters the tank, the level of mixture in the tank being monitored by the aforementioned level sensor 95 to ensure that the level of mixture in the tank remains within desired limits. Product pumped from the surge tank flows through outfeed line 91 to one or more locations, such as one or more processing or storage tanks (e.g., 13), which may be nearby or distant. If desired, the product may be recirculated via pump 43 back to the eductor-mixer 5 for additional mixing (thickening).

Figure 4:
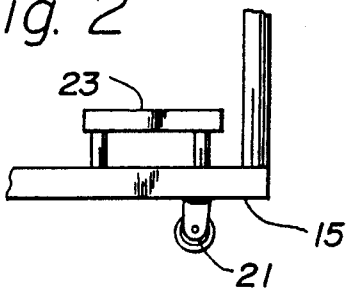
FIG. 4 is a schematic view of a different system using a module of the present invention.

FIG. 4 shows a alternative arrangement where the eductor-mixer 5 has a plurality of first inlets 33A, 33B adapted for connection to a plurality of sources 35A, 35B of particulate material. The sources may be any type of container, including those referred to above, capable of fluidizing particulate material. The containers may contain the same material, or they may contain different materials. In a situation where they contain the same material, material from one container (e.g., 35A) is conveyed to a respective inlet (e.g., 33A) to effect mixing of the material with working fluid. This may continue for some period of time (e.g., until container 35A is empty), after which further conveyance of material from that container is stopped and conveyance of material from a second container (e.g., 35B) to the appropriate inlet (e.g., 33B) is initiated. As the second container is emptied, the empty container may be replaced with a full container. Suitable valving associated with the inlets 33A, 33B of the eductor-mixer 5 is provided for permitting change-over from one container/inlet to the other. If the containers hold different materials, this valving can be operated to switch between containers/inlets as needed. It will be understood that the eductor-mixer 5 may have more than the two inlets 33A, 33B shown in FIG. 4.

It will be observed from the foregoing that the mixing module of the present invention and process carried out by the mixing module reduces problematic powder handling by virtue of the fact that the powder can be unloaded and mixed at one location and the resultant mixture pumped to a remote location for subsequent use. Moreover, the mixture is pumped immediately after it is mixed at a very high rate, i.e., a rate which is substantially equal to the rate of discharge from the mixer. Thus, the entire process is essentially an "in-line" process which does not require the need for a large holding tank. To the contrary, only a small surge tank is needed, the function of which is to hold product discharged by the eductor-mixer for only a very short duration of time before it is pumped to its final destination. As a result, the module can be made very compact for easy portability.

In view of the above, it will be seen that the several objects of the invention are achieved and other advantageous results attained.

As various changes could be made in the above products and processes without departing from the scope of the invention, it is intended that all matter contained in the above description and shown in the accompanying drawings shall be interpreted as illustrative and not in a limiting sense.

What is claimed is:

1. A mixing module for preparing dispersions, solutions and slurties by mixing a fluent particulate material received from a source of particulate material and a working fluid received from a source of pressurized working fluid, said module comprising a frame movable relative to said source of particulate material and with respect to said source of pressurized working fluid, an eductor-mixer mounted on and movable with the frame having a first inlet adapted to be connected to said source of fluent particulate material, a second inlet adapted to be connected to said source of pressurized working fluid, and a discharge adapted for discharging a mixture of the fluent particulate material and the working fluid at a first flow rate, a first connection assembly for connecting the first inlet of the eductor-mixer to said source of fluent particulate material, a second connection assembly for connecting the second inlet of the eductor-mixer to said source of pressurized working fluid, a small surge tank, separate from the source of working fluid, mounted on and movable with the frame for receiving the mixture discharged from the eductor-mixer, said surge tank having an outlet, and a pump mounted on and movable with the frame having an intake connected to the outlet of the surge tank and a discharge adapted for connection to an outfeed line for delivery of said mixture from the surge tank to a remote location, the pump being operable to pump mixture from the surge tank at a second flow rate not substantially less than the first flow rate.

2. A portable mixing module as set forth in claim 1 wherein said second flow rate is substantially equal to said first flow rate.

3. A portable mixing module as set forth in claim 1 wherein said surge tank has a maximum capacity of less than said first flow rate (in gallons of mixture per minute) multiplied times about two minutes.

4. A portable mixing module as set forth in claim 3 wherein said surge tank has a maximum capacity of less than said first flow rate (in gallons of mixture per minute) multiplied times about 0.2 minutes.

5. A portable mixing module as set forth in claim 1 wherein said surge tank is open to atmospheric pressure.

6. A portable mixing module as set forth in claim 1 wherein said second connection assembly comprises a first tubular fitting affixed to the frame, said first fitting having opposite ends, and a quick-connect, quick-disconnect device for connecting one end of the first fitting to a supply line from said source of pressurized working fluid, the opposite end of the first fitting being connected to the second inlet of the eductor-mixer.

7. A portable mixing module as set forth in claim 6 further comprising a second tubular fitting affixed to the frame, said second fitting having opposite ends, one of said opposite ends being connected to the discharge of said pump, and a quick-connect, quick-disconnect device for connecting the opposite end of the second fitting to an outfeed line for delivery of material discharged from the pump to a remote location.

8. A portable mixing module as set forth in claim 7 further comprising a supply line for conveyance of fluidized particulate material from said source of said material to said first inlet of the eductor-mixer, said supply line having a length of less than 20 feet.

9. A portable mixing module as set forth in claim 1 further comprising a sensor for generating output signals indicative of the level of mixture in the surge tank, and pump control means responsive to said output signals for increasing the discharge rate of said pump if the level of mixture in the surge tank rises to a first predetermined level, and for decreasing the discharge rate of the pump if the level of mixture in the surge tank falls to a second predetermined level.

10. A portable mixing module as set forth in claim 1 wherein said frame is on wheels.

11. A portable mixing module as set forth in claim 1 wherein said frame is on legs.

12. In combination with the mixing module of claim 1 wherein said eductor-mixer has a plurality of first inlets adapted for connection to a plurality of sources of particulate material, and a single said second inlet adapted for connection to a single said source of pressurized working fluid.

13. An in-line process for mixing a particulate fluent material received from a source of particulate material and a working fluid received from a source of pressurized working fluid, said process comprising moving a frame carrying an eductor-mixer and a small surge tank relative to said source of particulate material and relative to said source of pressurized working fluid to a set-up location, after moving the frame to said set-up location, connecting the source of particulate material to a first inlet of the eductor-mixer by means of a first supply line, and connecting the source of pressurized working fluid to a second inlet of the eductor-mixer by means of a second supply line, conveying said particulate material through said first supply line from the source of said particulate material to said first inlet of the eductor-mixer, pumping pressurized working fluid through the second supply line to the second inlet of the eductor-mixer, said eductor-mixer being operable to mix said particulate material and said working fluid to form a mixture of said particulate material and said working fluid, discharging said mixture from the eductor-mixer into the small surge tank at a first flow rate, and pumping said mixture out of the tank at a second flow rate approximately equal to said first flow rate for delivery to a remote location via an outfeed line.

14. A process as set forth in claim 13 further comprising sizing said surge tank to have a maximum capacity of less than said first flow rate (in gallons of mixture per minute) multiplied times about two minutes.

15. A process as set forth in claim 14 further comprising sizing said surge tank to have a maximum capacity of less than said first flow rate (in gallons of mixture per minute) multiplied times about 0.2 minutes.

16. A process as set forth in claim 13 wherein the mixing step is carried out at a location no more than 20 feet from said source of particulate material, and wherein said remote location is more than 20 feet from said surge tank.

17. A process as set forth in claim 13 wherein said eductor-mixer has a plurality of first inlets, said process further comprising conveying a particulate material from a first source to one of said first inlets to effect mixing of said particulate material with said working fluid, stopping conveyance of said first particulate material from said first source, and initiating conveyance of particulate material from a second source to another of said first inlets to effect mixing of said particulate material with said working fluid.

18. A process as set forth in claim 13 further comprising sensing the level of mixture discharged into the surge tank, and controlling the discharge rate of said pump according to said sensing step to maintain the level of mixture in the tank between first and second predetermined levels.

19. A process as set forth in claim 13 further comprising opening said surge tank to atmospheric pressure.

* * * * *